US007293984B2

(12) United States Patent
Ortiz, Jr.

(10) Patent No.: US 7,293,984 B2
(45) Date of Patent: Nov. 13, 2007

(54) SELF EXTINGUISHING SAFETY CANDLE WICKS AND METHODS OF MANUFACTURE OF THE WICKS

(76) Inventor: George Ortiz, Jr., 3800 Normandie Dr., Boise, ID (US) 83705

( * ) Notice: Subject to any disclaimer, the term of this patent is extended or adjusted under 35 U.S.C. 154(b) by 24 days.

(21) Appl. No.: 10/897,636

(22) Filed: Jul. 23, 2004

(65) Prior Publication Data

US 2006/0019209 A1 Jan. 26, 2006

(51) Int. Cl.
*F23N 5/00* (2006.01)
*F23D 3/16* (2006.01)
*F23D 3/18* (2006.01)

(52) U.S. Cl. ..... 431/289; 431/33; 431/35; 431/325

(58) Field of Classification Search ..... 431/289, 431/293, 325, 35, 295, 33; 126/291, 325
See application file for complete search history.

(56) References Cited

U.S. PATENT DOCUMENTS 370,562 A 9/1887 Schmitt
1,067,184 A * 7/1913 Lynch ..... 431/289
1,174,934 A 3/1916 Hawkins
2,001,377 A * 5/1935 Candy, Jr. ..... 431/291
2,184,666 A * 12/1939 Fredericks ..... 431/126
2,291,067 A 7/1942 Atkins
2,818,718 A 1/1958 Roberts

FOREIGN PATENT DOCUMENTS

EP 0018839 * 11/1980

* cited by examiner

*Primary Examiner*—Alfred Basichas
(74) *Attorney, Agent, or Firm*—Charles R. Clark

(57) ABSTRACT

The present invention relates to a novel self extinguishing safety candle wick that can be inserted into an axial vertical bore of a preformed solid fuel candle body or can be placed in a candle mold for casting of a solid fuel candle. The self extinguishing safety candle wick comprises a central support core having a plurality of combustion enabling wick portions fixed along the length of the core separated one from one another by interposed extinguishing gaps bridged by bare core portions. The invention also relates to methods of manufacture of the self extinguishing safety candle wick.

7 Claims, 3 Drawing Sheets

SELF EXTINGUISHING SAFETY CANDLE WICKS AND METHODS OF MANUFACTURE OF THE WICKS

CROSS-REFERENCE TO RELATED APPLICATIONS

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

In modern society, unwanted fires sometimes result from solid fuel candles that are lit and then left unattended. The need for safer candles to help guard against the tragedies that can unfold from unwanted fires remains important. An object of the present invention a self extinguishing safety candle wick is to make solid fuel candles safer and to lessen the likelihood of unwanted fires in those areas where candles are burned.

BRIEF SUMMARY OF THE INVENTION

Unwanted fires have resulted in the past from people lighting a solid fuel candle and then failing for whatever reason to extinguish the candle. During burning of a solid fuel candle, a liquefied candle fuel in a melted pool is conducted by capillary action up and out of the pool into a combustion enabling wick portion that is in direct contact with the pool for combustion in a candle flame burning around and about the combustion enabling wick portion above the pool and heat generated during the combustion heats the candle body and liquefies additional solid fuel into the pool or if all solid fuel has already melted further heats the pool. The present invention is a novel self extinguishing safety candle wick designed to decrease the level of danger presented by burning solid fuel candles.

A principal objective of this invention is to allow a burning candle to burn for a predictably controlled time period and then to self extinguish without the influence of devices or assistance beyond the wick and the candle.

A further object is to extinguish an unattended candle that has burned most of its fuel before materials in the vicinity of the bottom of the burning candle can be ignited by the candle flame.

Another object of the invention is, after a self extinguishment of a candle made with the invention has occurred, to allow a succeeding combustion enabling wick portion to be lit.

The instant invention is a self extinguishing safety candle wick comprising a central support core having a plurality of combustion enabling wick portions fixed along the length of the core separated one from one another by interposed extinguishing gaps bridged by bare core portions. By preselecting the lengths of the combustion enabling wick portions used in the making of a solid fuel candle, a candle maker can predictably control the length of time that the candle when lit will burn before it self extinguishes.

The central support core is strung through a plurality of combustion enabling wick portions that are isolated one from one another by bare core portions with each wick portion fixed in place along the length of the core by fixing means.

The fixing means may include drops of adhesive such as a cyanoacrylagic adhesive or candle wax or another suitable adhesive with each drop of adhesive adhering to a bare core portion of the core and fixing each combustion enabling wick portion in a selected position along the length of the core. The fixing means may also be a plurality of mechanically formed stops, deformations, bends, shoulders, hips, or flattened portions formed in bare core portions of the central support core that when formed restrict each combustion enabling wick portion to a selected position along the length of the core.

In the preferred embodiment, the central support core is a malleable thin single strand solid zinc-based wire that is progressively consumed or oxidized or disintegrated from top to bottom in the candle flame as the candle burns. The preferred central support core is a nonwicking core. In the preferred embodiment, each combustion enabling wick portion is made of a tube of prewaxed braided cotton wicking material or another suitable fibrous material that surrounds a portion of the central support core and will allow and sustain capillary action of melted solid fuel up, throughout, and along the length of the combustion enabling wick portion.

For purposes of this invention, nonwicking cores are defined as cores that exhibit little or no capillary action with respect to liquified solid fuel. Such nonwicking cores will not sustain combustion across an extinguishing gap bridged by a bare core portion located below a burning combustion enabling wick portion. When the level of the melted pool drops below the bottom edge of the then burning combustion enabling wick portion, the candle will begin to extinguish and will go out when all the combustible material including fuel in the burning combustion enabling wick portion has been consumed.

An alternative central support core that is a nonwicking core may be used in place of the preferred single strand zinc-based wire. A nonwicking core also can be made from a thin length of wood such as a hard wood that is used in common wooden toothpicks or basswood, from a strand of thin gauge spaghetti, or from another suitable nonwicking material such as another metal-based wire, or bamboo. Preferably, each alternative nonwicking core when used in a self extinguishing safety candle wick is progressively consumed or oxidized or disintegrated from top to bottom in the candle flame as the candle burns.

When relighting a candle made with a self extinguishing safety candle wick, a user lights the next combustion enabling wick portion. The candle then burns down until the next extinguishing gap along the core is encountered and then the burning candle goes out again.

Additional and various other objects and advantages attained by the invention will become more apparent as the specification is read and the accompanying figures are reviewed.

DETAILED DESCRIPTION OF THE INVENTION

Figure 1:
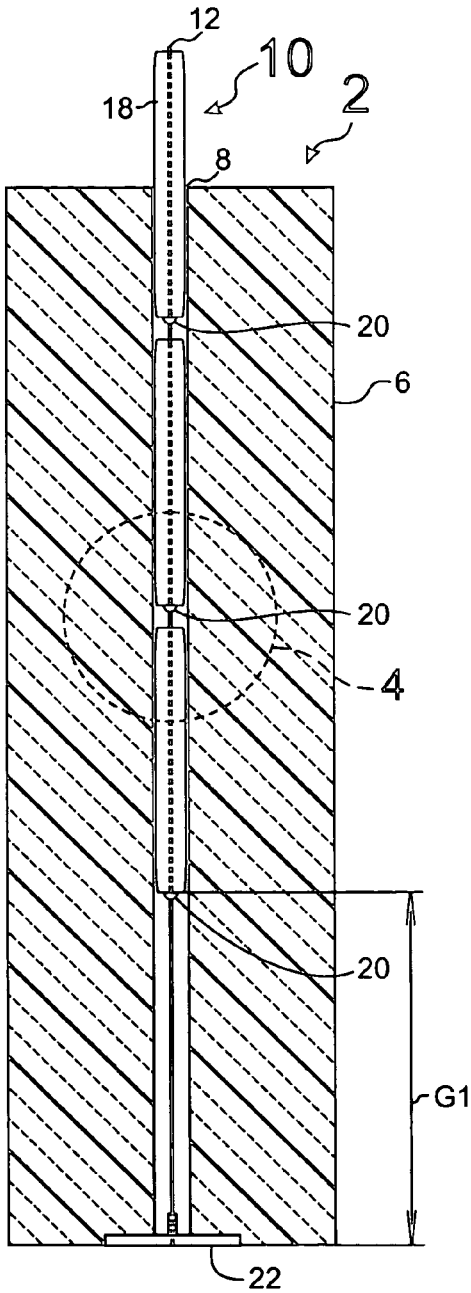
FIG. 1 is a partially cutaway side view of a self extinguishing safety candle wick showing a preferred embodiment with the wick inserted in a candle bore of a solid fuel candle.

FIG. 1 shows a solid fuel candle 2 having a candle body 6 made of solid fuel and preferably an axial vertical candle bore 8 with a novel self extinguishing safety candle wick 10 inserted in the candle bore. The candle body 6 can be made of solid fuels such as paraffin wax, vegetable wax, beeswax, or other suitable meltable solid fuel.

Figure 2:
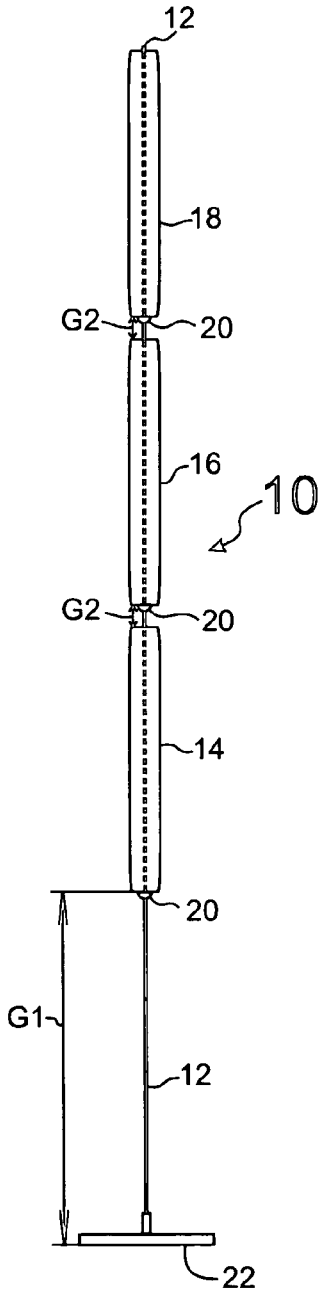
FIG. 2 is a side view of a self extinguishing safety candle wick showing a plurality of combustion enabling wick portions fixed along the length of a central support core by drops of adhesive and showing a base core clip.

The self extinguishing safety candle wick 10 as shown in FIGS. 1 and 2 comprises a central support core 12 having a lower end and an upper end. A plurality of combustion enabling wick portions 14, 16, and 18 are tubular and are strung like beads on the core 12 and each combustion enabling wick portion is fixed in place and separated one from one another along the length of the core by a fixing means. The plurality of combustion enabling wick portions includes a bottom combustion enabling wick portion 14 and the lower end of the core 12 extends downward below and beyond the bottom combustion enabling wick portion and establishes a bottom extinguishing gap G1 bridged by a bare core portion.

Figure 6:
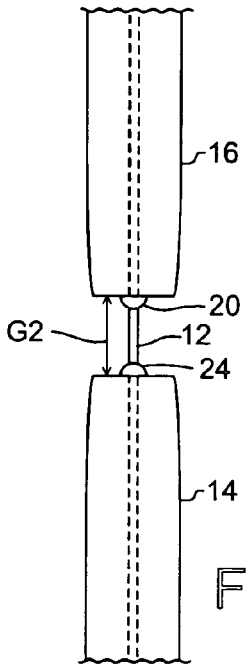
FIG. 6 is a partial side view of a self extinguishing safety candle wick showing an interposed extinguishing gap G2 bridged by a bare core portion between an upper combustion enabling wick portion and a succeeding lower combustion enabling candle wick portion, showing a drop of adhesive fixing the upper candle wick portion in position above a bare core portion, and showing a drop of adhesive fixing a lower combustion enabling wick portion in position below the bare core portion.

In FIGS. 1 to 6, the fixing means comprises a plurality of drops of adhesive 20 with each drop adhering to a bare core portion and fixing each combustion enabling wick portion 14, 16, and 18 in position above the respective bare core portion. In FIG. 6, a drop of adhesive 24 adheres to the core 12 and fixes combustion enabling wick portion 14 below the bare core portion.

Preferably, as shown in FIGS. 1 to 3 and 10 to 12, a lower end of the core 12 or 12' extends downward below and beyond a bottom combustion enabling wick portion 14 and establishes a bottom extinguishing gap G1 bridged by a bare core portion at the bottom of the self extinguishing safety candle wick 10, 10', or 10". Preferably, the bottom extinguishing gap G1 is bridged by a bare core portion that ranges from about one quarter inch to one inch (about 6.1 mm to 25.4 mm) in length.

Figure 3:
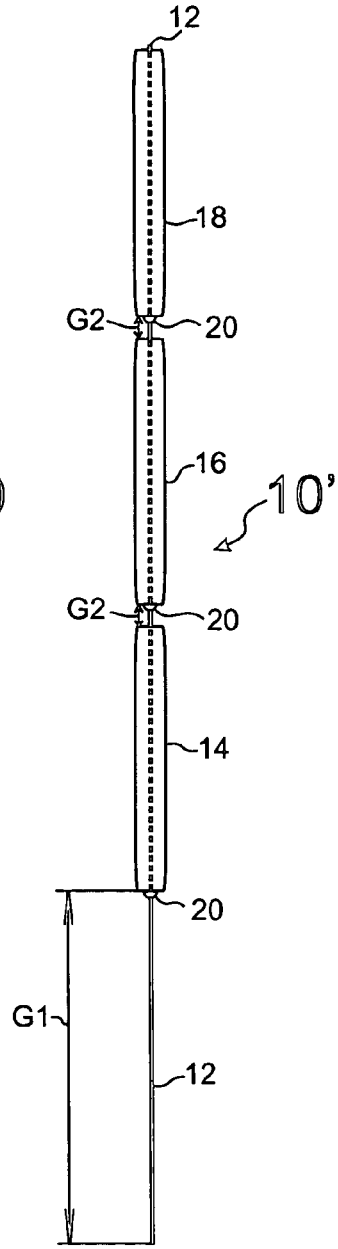
FIG. 3 is a side view of an alternative embodiment of a self extinguishing safety candle wick showing a plurality of combustion enabling wick portions fixed along the length of a central support core by drops of adhesive.
Figure 4:
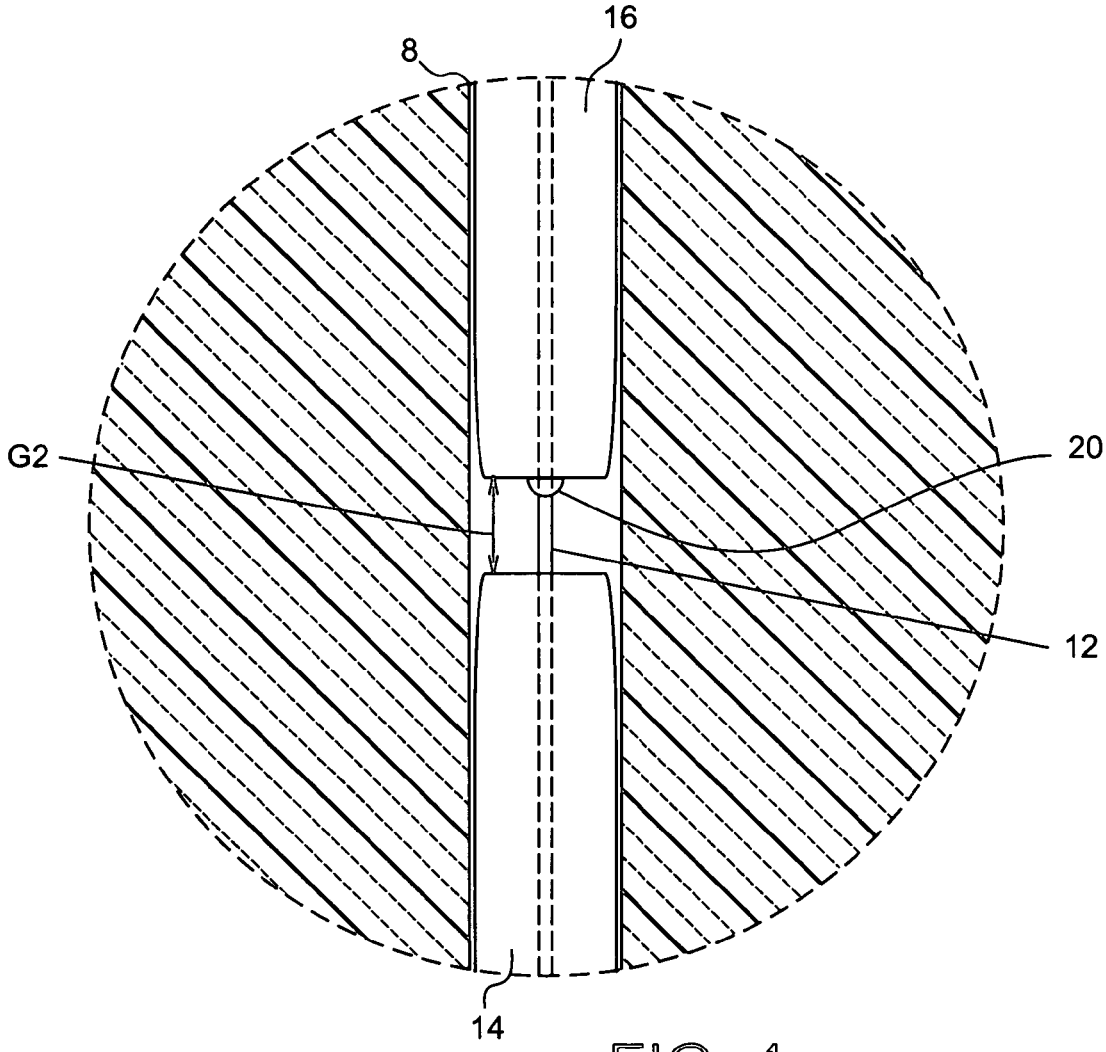
FIG. 4 is an enlarged view of an indicated portion of FIG. 1.
Figure 5:
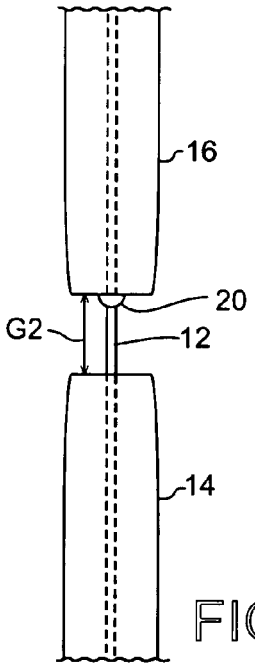
FIG. 5 is a partial side view of a self extinguishing safety candle wick showing an interposed extinguishing gap G2 bridged by a bare core portion between an upper combustion enabling wick portion and a succeeding lower combustion enabling candle wick portion and showing a drop of adhesive fixing the upper candle wick portion in position above the bare core portion.
Figure 10:
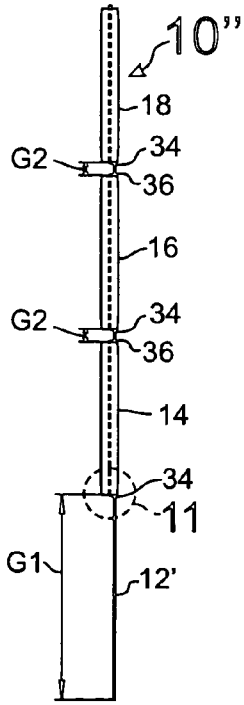
FIG. 10 is a side view of an alternative embodiment of a self extinguishing safety candle wick.
Figure 11:
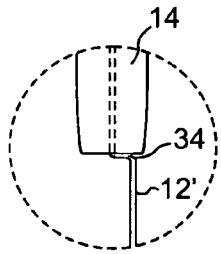
FIG. 11 is an enlarged view of an indicated portion of FIG. 10.

As shown in FIGS. 1 and 2, a base core clip 22 may be attached by crimping or by another suitable method such as are known in the art to the lower end of the central support core 12. The base core clip 22 may be made from thin gauge metal or from a suitable plastic material. Alternatively, as shown in FIGS. 3 and 10, effective and useful self extinguishing safety candle wicks 10' and 10" can be made without having a base core clip 22.

Preferably, as shown in FIGS. 1 to 10 and 12, the plurality of combustion enabling wick portions 14, 16, and 18 are fixed along the length of the core and separated one from one another by an interposed extinguishing gap G2 bridged by a bare core portion. Each interposed extinguishing gap G2 is bridged by a bare core portion of the central support core 12 or 12' that bridges a separating distance between succeeding combustion enabling wick portions 14,16, and 18. Preferably, each interposed extinguishing gap G2 is one sixteenth of an inch (about 2 mm) in length when a self extinguishing safety candle wick 10 having combustion enabling wick portions with diameters of about one-sixteenth of an inch (about 2 mm) is used in a solid fuel candle 2 made of common candle wax and the candle has a diameter ranging from about one half inch to about two inches (about 12.25 mm to 50.8 mm). Depending upon the burning characteristics of the specific solid fuel from which a candle is made, each interposed extinguishing gap G2 may range from about one thirty-secondth of an inch to about one-eighth of an inch (about 1 mm to about 4 mm) in length.

In FIGS. 1 to 12, a number of alternative fixing means are illustrated.

FIGS. 1 to 6 show a fixing means comprising drops of adhesive 20 and 24 fixing combustion enabling wick portions 14,16, and 18 in positions along the length of the central support core 12. Drops of adhesive 20 fix the combustion enabling wick portions 14, 16, and 18 above respective bare core portions of the central support core 12. In FIG. 6, a drop of adhesive 24 fixes the combustion enabling wick portion 14 below the bare core portion.

Figure 7:
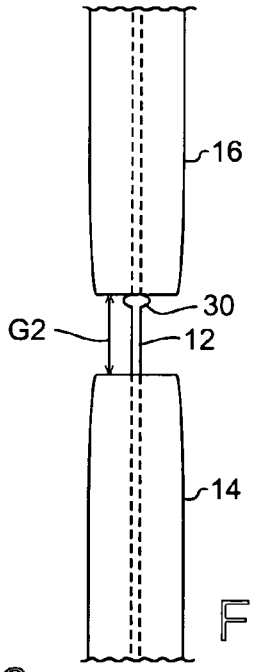
FIG. 7 is a partial side view of a self extinguishing safety candle wick showing an interposed extinguishing gap G2 bridged by a bare core portion between an upper combustion enabling wick portion and a succeeding lower combustion enabling candle wick portion and showing a flattened portion of the central support core fixing the upper candle wick portion in position above the bare core portion.
Figure 8:
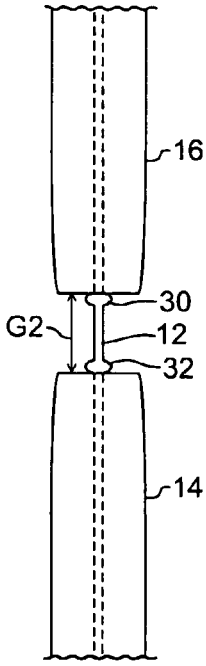
FIG. 8 is a partial side view of a self extinguishing safety candle wick showing an interposed extinguishing gap G2 bridged by a bare core portion between an upper combustion enabling wick portion and a succeeding lower combustion enabling candle wick portion, showing a flattened portion of the central support core fixing the upper candle wick portion in position above the bare core portion, and showing a lower flattened portion of the central support core fixing a lower combustion enabling wick portion in position below the bare core portion.
Figure 9:
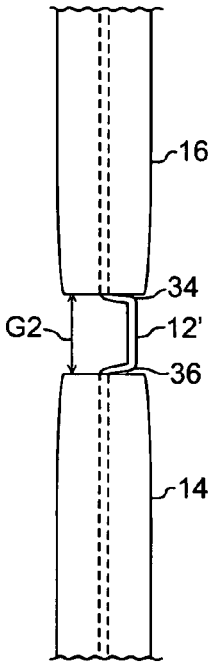
FIG. 9 is a partial side view of a safety candle wick showing an interposed extinguishing gap G2 bridged by a bare core portion between an upper combustion enabling wick portion and a succeeding lower combustion enabling candle wick portion, showing a shoulder portion of the central support core fixing the upper candle wick portion in position above the bare core portion, and showing a hip portion of the central support core fixing a lower combustion enabling wick portion in position below the bare core portion.

FIGS. 7 and 8 show a fixing means comprising a flattened portion 30 of the central support core 12 and a lower flattened portion 32 of the central support core that are mechanically formed in a bare core portion by jaws of appropriately sized pliers or by an appropriate hammer and anvil apparatus or other suitable deformation apparatus. The flattened portions 30 and 32 are wider than the interior axial bores of the combustion enabling wick portions 14 and 16. Flattened portions of similar configuration to flattened portions 30 and 32 can be used to establish other interposed extinguishing gaps G2 along the length of the central support core.

FIGS. 9 to 12 show fixing means comprising a plurality of shoulder portions 34 of an alternative central support core 12' and a plurality of hip portions 36 of the alternative central support core that are mechanically formed in a plurality of bare core portions by jaws of appropriately sized pliers or by an appropriate hammer and anvil apparatus or other suitable deformation apparatus. The shoulder portions 34 support from below the respective combustion enabling wick portions 14,16, and 18. The hip portions 36 rest and bear upon the respective combustion enabling wick portions 14 and 16.

Figure 12:
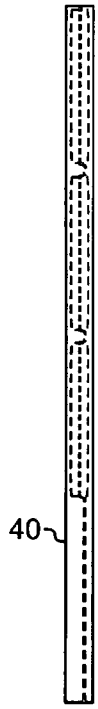
FIG. 12 is a side view of an alternative embodiment of a self extinguishing safety candle wick showing a self extinguishing safety candle wick overcoat.

FIG. 12 shows a self extinguishing safety candle wick 10" with a coating 40 of candle wax over the entire length of the self extinguishing safety candle wick. The coating 40 can be applied over each of the three embodiments of the self extinguishing safety candle wick 10" or 10, or 10' by dipping or by another suitable method. Preferably, the coating 40 provides a smoother and more uniform cylindrical shape to the self extinguishing safety candle wick 10, 10', or 10' that may facilitate insertion of the candle wick into a candle bore 8.

One or another of the illustrated embodiments of the self extinguishing safety candle wick 10, 10', or 10" can be inserted into a candle bore of a preformed candle body. Alternatively, one or another of the wicks 10, 10', or 10" can be placed in a mold or a container and a heated and liquefied solid fuel can then be poured into the mold or container around the wick and allowed to cool and solidify.

Self extinguishing safety candle wicks 10, 10', or 10" can be made from a candle wick commercially available from Yaley Enterprises, 7664 Avianca Drive, Redding, Calif. 96002 as a "9" Pre-waxed Small Wire Wick" and packaged in a package of six wicks (No. 120100).

For example, a method for making a self extinguishing safety candle wick 10' from a pre-waxed small wire wick comprises the following steps:

a. providing a pre-waxed small wire wick having a top end and a base core clip at an opposite end, the small wire wick having a central support core throughout the length of the small wire wick, the central support core closely and radially surrounded by a tubular pre-waxed combustion enabling wick;

b. cutting off the base core clip immediately above the base core clip;

c. determining number of combustion enabling wick portions to form in the safety candle wick;

d. determining lengths for each combustion enabling wick portion;

e. determining a rough length for a bottom extinguishing gap G1;

f. determining number of interposed extinguishing gaps G2 to form in the safety candle wick;

g. determining a uniform length for each interposed extinguishing gap G2;

h. determining a uniform length for each bare core portion needed to form each interposed extinguishing gap G2;

i. computing a length to remove from the tubular combustion enabling wick using the following equation: length to remove equals (length for the bottom extinguishing gap G1) plus ((number of interposed extinguishing gaps G2 to form) times (uniform length for each bare core portion to form each interposed extinguishing gap G2));

j. removing the length to remove from the tubular combustion enabling wick from around the central support core starting from the upper end of the small wire wick and downward towards the opposite end;

k. determining locations along the small wire wick for annular cuts to form lengths for each combustion enabling wick portion;

l. making an annular cut through the tubular combustion enabling wick in a plane generally perpendicular to the longitudinal axis of the small wire wick at each of the locations determined in step k whereby a plurality of combustion enabling wick portions are formed;

m. separating and distributing the combustion enabling wick portions one from one another along the central support core with a bare core portion of the uniform length for each bare core portion needed to form each interposed extinguishing gap G2 between successive combustion enabling wick portions and with a bare core portion at one end of the core equal in length to the rough length for the bottom extinguishing gap G1; and n. selecting and using a fixing means to fix the combustion enabling wick portions along the central support core.

Attaching a base core clip to the lower end of the bare core portion that forms the bottom extinguishing gap G1 of a self extinguishing safety candle wick 10' will yield an alternative embodiment of the self extinguishing safety candle wick 10.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A self extinguishing safety candle wick comprising a central support core strung through a plurality of combustion enabling wick portions, said combustion enabling wick portions being tubular, said combustion enabling wick portions isolated one from one another by bare core portions with each said combustion enabling wick portion fixed in place along the length of said core by a fixing means, said plurality of combustion enabling wick portions includes a bottom combustion enabling wick portion and said lower end of said core extends downward below and beyond said bottom combustion enabling wick portion and establishes a bottom extinguishing gap bridged by a bare core portion.

2. A self extinguishing safety candle wick according to claim 1 wherein said fixing means comprises drops of adhesive with each said drop of adhesive adhering to a bare core portion of said core and fixing each said combustion enabling wick portion in a selected position along the length of said core.

3. A self extinguishing safety candle wick according to claim 1 wherein said central support core is a nonwicking core.

4. A self extinguishing safety candle wick according to claim 3 wherein said nonwicking core is a single strand zinc-based wire.

5. A self extinguishing safety candle wick according to claim 4 wherein said fixing means comprises a plurality of mechanically formed stops, deformations, bends, shoulders, hips, or flattened portions formed in bare core portions of said central support core that when formed restrict each said combustion enabling wick portion to a selected position along the length of said core.

6. A self extinguishing safety candle wick according to claim 5 wherein said flattened portions are wider than the interior axial bores of the combustion enabling wick portions.

7. A self extinguishing safety candle wick according to claim 3 wherein said nonwicking core made from a strand of thin gauge spaghetti.

* * * * *